United States Patent [19]

Rankin

[11] 4,294,380

[45] Oct. 13, 1981

[54] TELLER MACHINES AND METHODS OF OPERATION THEREOF

[75] Inventor: Kenneth F. Rankin, St. Albans, England

[73] Assignee: Chubb Integrated Systems Limited, Brighton, England

[21] Appl. No.: 40,786

[22] Filed: May 21, 1979

[51] Int. Cl.[3] ..... E05G 7/00

[52] U.S. Cl. ..... 221/195; 109/19; 194/DIG. 26

[58] Field of Search ..... 221/1, 12, 13, 151, 221/153, 195; 194/4, DIG. 6, DIG. 26; 222/2; 235/381; 109/19, 24.1

[56] References Cited

U.S. PATENT DOCUMENTS

| | | | |
|---|---|---|---|
| 2,105,204 | 1/1938 | Soderholm | 109/19 |
| 2,840,265 | 6/1958 | Noyes | 221/13 X |
| 3,294,342 | 12/1966 | McClure et al. . | |
| 3,543,904 | 12/1970 | Constable et al. | 194/4 |
| 3,876,864 | 4/1975 | Clark et al. | 235/381 X |
| 3,892,948 | 7/1975 | Constable | 221/2 X |
| 3,949,364 | 4/1976 | Clark et al. | 340/147 A |
| 4,020,328 | 4/1977 | Coulthurst | 235/381 |
| 4,066,253 | 1/1978 | Lundbald et al. | 271/4 |
| 4,134,537 | 1/1979 | Glaser et al. | 235/381 X |

*Primary Examiner*—F. J. Bartuska

*Attorney, Agent, or Firm*—Pollock, Vande Sande & Priddy

[57] ABSTRACT

A bank teller-terminal machine includes a banknote dispenser that in a first mode of machine operation assists a human teller in providing personal service to customers across a counter under control of data entry made via a keyboard-and-display set at the teller's station. Removal of a key from a lock on the teller's keyboard switches the machine to its second, automatic, operational mode in which the dispenser dispenses under automatic programmed control in response to requests entered via a card reader and keyboard at the customer's station. The dispenser dispenses notes sideways into a pan which is sunk into the counter top and which has a lid slideable by the human teller to regulate customer access to the dispensed notes in the first, manned mode of operation.

2 Claims, 4 Drawing Figures

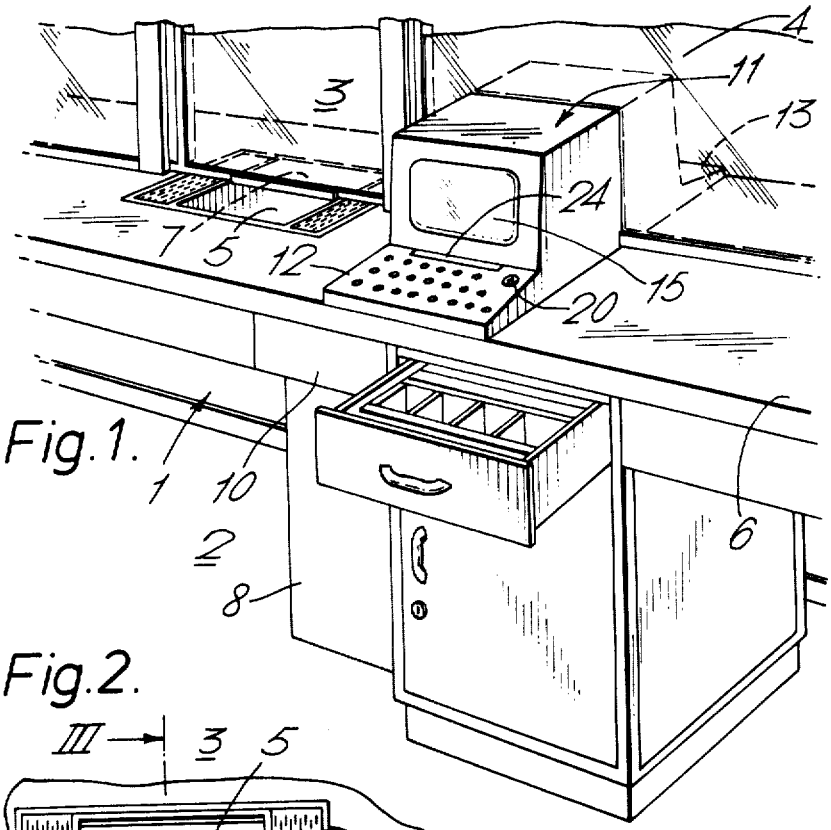
Fig.1.
Fig.2.
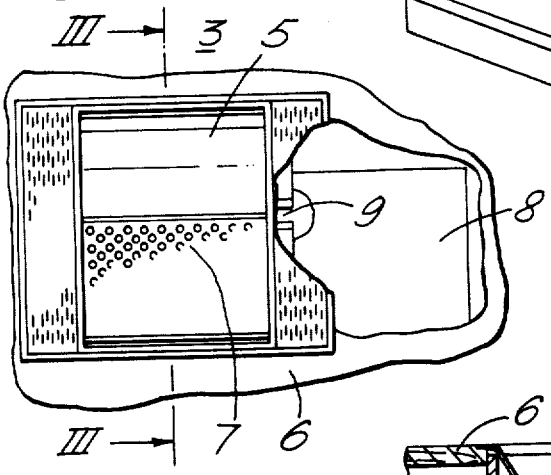
Fig.3.
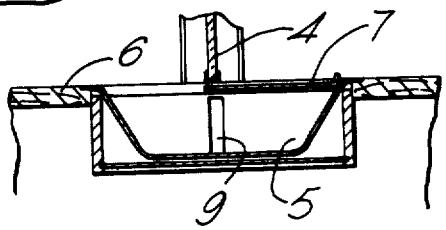

TELLER MACHINES AND METHODS OF OPERATION THEREOF

This invention relates to teller machines and to methods of operation thereof.

Automated teller machines have been used extensively by banks and other institutions for dispensing cash (normally in the form of banknotes) or other items (for example travellers cheques) in response to requests made to the machines by customers. Each request in this context usually involves keyed-entry into the machine of a secret number, and comparison of this number within the machine for corresponding with another number entered by the customer. The other number entered may be derived from data encoded on a card that is presented to the machine by the customer as part of the request, and in this respect may be (as in the case, for example, of the machine disclosed in U.S. Pat. No. 4,020,326 issued to I. J. Coulthurst on Apr. 26, 1977) the customer's account number read by the machine from the presented card, or may be (as in the case, for example, of the machine disclosed in U.S. Pat. No. 3,543,904 issued to G. E. P. Constable et al. on Dec. 1, 1970) computed within the machine from a plurality of numbers read from the card. Alternatively, the other number may be (as in the case, for example, of the machine disclosed in U.S. Pat. No. 3,892,948 issued to G. E. P. Constable on July 1, 1975) a number keyed into the machine by the customer separately from the secret number.

Automated teller machines of the above general kind have been installed to be accessible externally of the bank branch or office so as to enable banknotes or other items to be dispensed to customers and other transactions to be performed at all times and in particular when the bank is not open for business. However, such machines have also been installed within the branch or office so as to be available for operation by customers only when within the banking hall or lobby. In this latter respect the machine is capable of providing automatically a service which is equivalent in many respects, or which is at least supplementary, to that provided by the human teller or cashier. With such within-bank installations it is readily possible for the workload on the human tellers or cashiers in the bank to be reduced and for the service provided to customers to be maintained at a desired minimum level irrespective of absence of any one or more of them from customer-service. Although such teller machines could be utilized to replace human tellers altogether for all straightforward cash-dispensing and basic teller-operations, this is not regarded as commercially desirable since most customers prefer to receive personal service. The services of a human teller are in any case required in order to deal with enquiries, difficulties and the more complicated transactions.

The present invention recognizes that an automated teller machine provided to enable customer-service to be maintained or supplemented, includes a dispensing facility that can be utilized with advantage to assist in the provision of personal service to customers from a human-teller's station. It is already known to install dispensing equipment at a teller's station for use by the teller in counting out and assembling cash in coin and, or, alternatively, banknote form for delivery to the customer by hand, but such equipment, being exclusively for operation under control of the teller, cannot be utilized to maintain customer-service in the absence of the human teller from the teller's station.

A banking system is described in U.S. Pat. No. 3,876,864 issued to R. W. Clark et al. on Apr. 8, 1975, in which an automated teller machine that is installed remotely from bank premises can be used by a customer to perform requested transactions under automatic programmed control in the conventional way, but may be switched to a mode of operation in which the customer is assisted in completing the transaction by bank staff. In this latter respect the customer can operate a key-switch of the teller machine to establish a communications link with a human teller located at the distant bank premises. Through this link the transaction can be completed by the customer under instruction from the distant, human teller, or directly by the human teller operating a keyboard at the distant location. When the requested transaction involves the dispensing of cash to the customer, the human teller accordingly exercises a limited degree of control over the dispensing equipment of the remote machine, but the involvement of the human teller is essentially confined to that of acting at a distance to assist the customer at the remote location in operating the automated machine there; the human-teller involvement simply supplements the service available to customers at the remotely-located machine. This earlier-proposed system is furthermore not concerned with, nor is applicable to, utilization of the dispenser equipment of the automated teller machine for assisting with the provision of personal service to customers at the human-teller's location.

The present invention in one of its aspects, provides a method of operating a teller machine that includes a dispenser for dispensing items for delivery to a customer in accordance with a customer-requested transaction, the machine being switchable to operate selectively in either of two modes in the first of which the dispenser operates to dispense items under control of a human teller occupying an allotted teller's station, and in the second of which the dispenser operates to dispense items under automatic programmed control in accordance with customer operation of the machine, the said method including the improvement wherein the machine is switched to operate in the first or second mode by the human teller in dependence, respectively, upon whether or not the teller's station is to be occupied to provide personal service to the customer, and the position to which the dispenser dispenses the said items is within reach of the human teller when occupying the said teller's station so that delivery to the customer of the items dispensed when the machine is operating in its said first mode is within the personal influence of the human teller.

According to another aspect of the present invention there is provided in a teller machine in which a dispenser is operable to dispense items for delivery to a customer in accordance with a customer-requested transaction, the machine including means that is actuable for switching the machine to operate selectively in either of two modes in the first of which the dispenser operates to dispense items under human control exercised from a teller's station, and in the second of which the dispenser operates to dispense items under automatic programmed control in accordance with customer requests made from a customer's station, the improvement wherein the two stations are located close to one another, the said actuable means is located at the teller's station and the dispenser includes means to dispense the said items to a position that is within reach from both stations whereby delivery to the customer of items dispensed to said position when the machine is operating in its said first mode is within the personal influence of a human teller acting from the said teller's station.

The present invention in both of the above aspects accordingly provides for the utilization of the dispenser of the teller machine under control of the human teller to assist in affording customers the generally-preferred personal service while the teller's station is occupied. The dispenser on the other hand is utilized under automatic control in machine service to the customer while the teller's station is unoccupied and personal service is accordingly not available from the relevant transaction location. Thus the present invention enables the most effective utilization to be made of the equipment provided, in meeting customer's transaction needs.

The customer's and teller's stations may be located on opposite sides from one another of a counter, and in these circumstances the dispenser may be arranged to dispense items into a receptacle mounted with the counter intermediate the two stations. The receptacle may have a lid that can be actuated by the human teller from the said teller's station to obstruct or enable, selectively, access by the customer to the contents of the receptacle.

Although the method and machine according to the present invention are especially applicable for use in banks, the invention is not limited to such use and may be utilized in other applications in other institutions and offices. Furthermore, although the method and machine are especially applicable where cash is to be dispensed, they may be used alternatively, or in addition, for dispensing other items such as, for example, travellers cheques and tickets.

A bank teller machine and a method of its operation in accordance with the present invention will now be described, by way of example, with reference to the accompanying drawings, in which:

FIG. 1 is a perspective view of a bank installation including the teller machine;

FIGS. 2 and 3 are a plan and a sectional side-elevation, respectively, of a cash receptacle utilized in the installation, the section of FIG. 3 being taken on the line III—III of FIG. 2.

Figure 4:
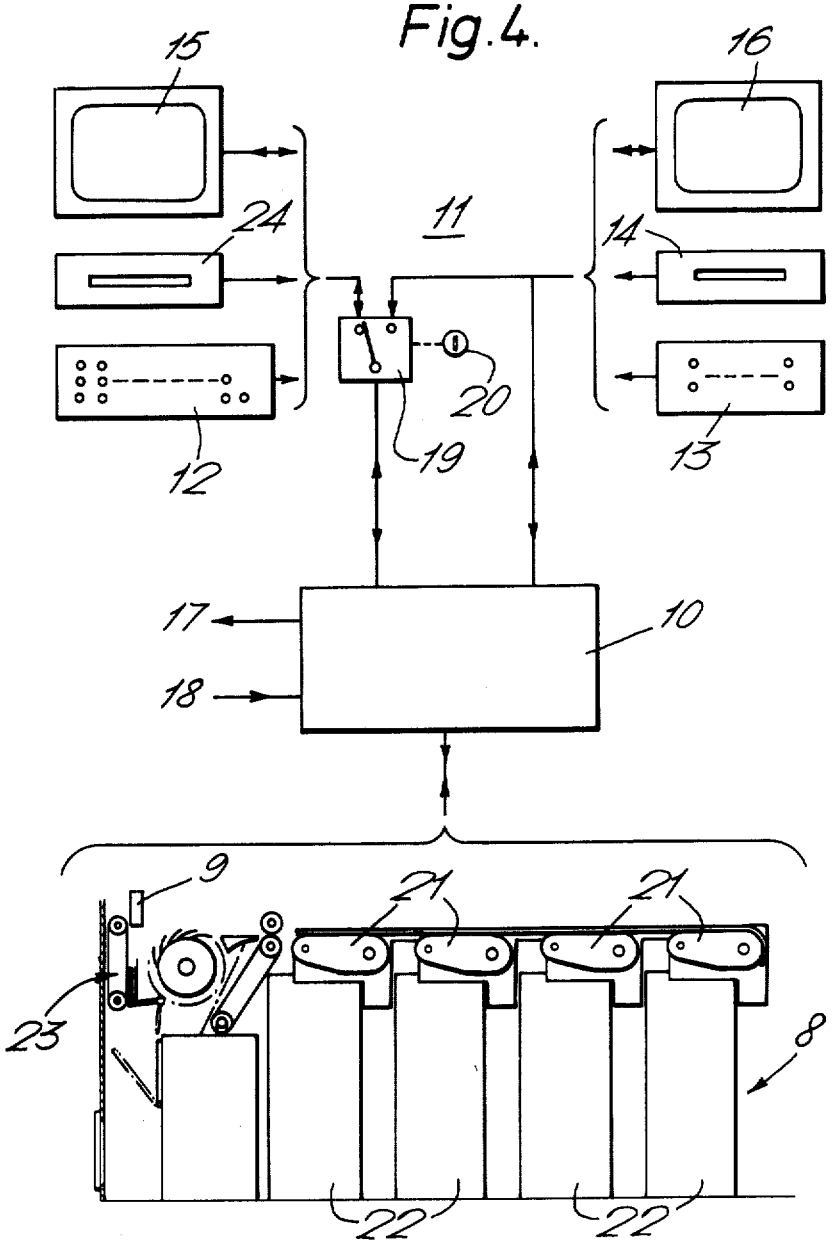
FIG. 4 is a schematic representation of the teller machine.

The bank teller machine to be described is for use in providing service to customers in a bank branch or office. More particularly the teller machine is associated with the normal bank counter that separates customers from bank staff in the banking hall or lobby of the branch or office. The machine includes a banknote dispenser that is installed at a transaction location of the counter for dispensing banknotes into a position intermediate the teller's and customer's stations opposite one another across the counter-top, at that location.

There are two principal modes of operation of the machine and operation is in accordance with one or the other of these in dependence upon whether or not the teller's station is manned. While the teller's station is manned the machine operates in a first mode to assist the human teller or cashier in execution of transactions requested by customers, whereas in the second mode the machine is operative in the manner of an automated teller, to dispense cash or perform certain other requested tasks in accordance with automatic machine-programmed procedures. With this machine therefore, it is possible to ensure that service is always available from the transaction location whether or not the teller's station is manned, and moreover that while the station is manned the machine is operative to assist the human teller in the tasks to be performed.

Referring especially to FIG. 1 of the drawings, the counter 1, which separates the teller's and customer's stations 2 and 3, respectively, from one another at the transaction location, is provided with conventional anti-bandit screening 4 and incorporates a stainless-steel pan 5 sunk into the counter-top 6 to enable passage of banknotes and other items between the teller and customer, beneath the screening 4. The pan 5 has a horizontally-sliding lid 7 that can be slid forwardly or backwardly by the teller to obstruct or enable, selectively, access by the customer to the contents of the pan 5.

The banknote dispenser 8 of the machine is installed under the counter-top 6 to dispense banknotes through a slot 9 (FIGS. 2 and 3) sideways into the receptacle constituted by the pan 5. Dispensing of banknotes by the dispenser 8 is regulated by a data-processing unit 10 which is coupled to a unit 11 mounted on the counter-top 6. The unit 11 has two keyboards 12 and 13 for use in signalling data to the data-processing unit 10, the keyboard 12 (which provides a wider range of function key-inputs than the keyboard 13) being located to be readily accessible for operation from the teller's station 2. The keyboard 13, on the other hand, is located together with a card reader 14 (FIG. 4) of the unit 11, on the other side of the counter 1 to be accessible to customers from the customer's station 3. Information and instructions signalled from the unit 10 during the first mode of operation are displayed to the teller in alphanumeric characters on a cathode-ray-tube screen 15 of the unit 11 above the keyboard 12. On the other hand, instructions and confirmatory information applicable to the second mode of operation are signalled from the unit 10 for display in alpha-numeric form on a screen 16 (of a cathode-ray tube, or some other, simpler, display-device: FIG. 4) located above the keyboard 13 to be visible from the customer's station 3. The data-processing unit 10 is coupled via a communications line 17 (FIG. 4) into the banking-terminal system of the bank branch or office so that identification information, instructions and other details of a customer's request or enquiry entered by the teller via the keyboard 12, are transmitted on-line to the bank's central data-processing system. The central data-processing system in response to the request or enquiry transmits data, instructions and other information, including, for example, approval or otherwise of a requested withdrawal of cash, back to the data-processing unit 10 via a communications line 18. The functioning of the data-processing unit 10 in accordance with the signalled response from the central system is dependent on whether the machine is operating in the first, manned or second, unmanned mode.

The machine operates in the first or second mode according to the setting of a two-position switch 19 (FIG. 4) of the unit 11. The setting of the switch 19 is controlled from a lock 20 mounted with the keyboard 12, and selection of the particular switch-setting (illustrated in FIG. 4) appropriate to operation of the equipment in the first mode, is effected by insertion and turning of the appropriate key in the lock 20. The key is personal to the teller allotted to station 2 and is withdrawn, re-locking the lock 20, whenever the teller leaves the station unmanned. Such withdrawal and consequent re-locking of the lock 20 sets the switch 19 to the position in which the second mode of operation of the machine is selected.

When the teller's station 2 is manned and the teller has unlocked the lock 20 so as to set the switch 19 to select the first mode of operation of the machine, the unit 11 is operative to assist the cashier in transactions carried out across the counter-top 6 via the pan 5. More particularly, the cashier may utilize the keyboard 12 to make enquiries via the unit 10 as to the status of the customer's account and to seek instructions in the handling of a requested transaction; replies to the enquiries and the instructions requested are displayed on the screen 15. No information will in general be displayed on the screen 16 in this mode, signalling from the unit 10 for such display, and also from the keyboard 13 to the unit 10, being normally inhibited by the setting of the switch 19 at this time. However the equipment when operating in the first mode offers especial advantage for transactions involving the dispensing of cash to the customer.

In the latter respect the banknote dispenser 8 has the facility for dispensing banknotes of any of a multiplicity of different denominations—four in the case illustrated—in any selected number of each, under control of the data-processing unit 10. Release of the dispenser 8 to dispense the appropriate number and denomination-mix of banknotes, is made by the unit 10 only after certain prescribed procedures appropriate to the relevant transaction have been followed through by the teller and approval of the transaction has been received from the central data-processing system. The procedures involved include entry by the teller into the unit 10 using the keyboard 12, of the total amount to be dispensed to the customer together with information as to any mix of denominations requested by the customer for the make up of this amount. This, provided approval of the transaction is received, conditions the unit 10 to drive a note-transport mechanism 21 (FIG. 4) of the dispenser 8 to withdraw from four cassettes 22 that store supplies of the different denominations, the numbers of notes appropriate to the relevant denomination-mix; the unit 10 is programmed to impose a prescribed optimum mix where no specific mix-request is entered by the teller. The withdrawn notes are collected together and dispensed in one bundle through the slot 9 into the pan 5 by a mechanism 23 of the dispenser 8. The machine is accordingly of especial assistance to the teller in facilitating rapid counting out and assembly of the appropriate notes required to meet the customer's request. Delivery to the customer of the dispensed cash remains within the influence of the teller since the bundle of notes in the pan 5 is within easy reach from the teller's position 2. Moreover the teller may position the sliding lid 7 forwardly so that customer access to the contents of the pan 5 is obstructed until the lid 7 is withdrawn by the teller to allow the customer to take delivery of the notes from the pan 5.

The teller removes the key from the lock 20 whenever the teller's station 2 is left unmanned, and this automatically actuates switch 19 to the setting appropriate to the second mode. In this mode instructions to the customer are transmitted from the unit 10 for display on the screen 16; no display in general takes place on the screen 15. More particularly the customer is instructed to insert his or her card in the card reader 14. Once this has been done and information, including the customer's account number, has been read from the card and received in the unit 10, the unit 10 instructs the customer through display on the screen 16 to enter his or her individual, secret number. The customer follows this instruction by manipulation of the keyboard 13 and is then invited to use the same keyboard 13 to identify the teller-service required. The secret number entered is compared for correspondence in the unit 10 with the account number read from the card, and it is only in the event that such correspondence exists, that operation can proceed. Assuming correspondence does exist, the unit 10 proceeds through the program-sequence appropriate to the service identified by the customer. When the customer requires to withdraw cash, the transaction proceeds after entry by the customer, using the keyboard 13 again, of the amount required, and receipt via the unit 10 of approval of the transaction from the central data-processing system. Assuming approval is received, the unit 10 actuates the banknote dispenser 8 to withdraw the appropriate banknotes from the cassettes 22 and to deliver them through the slot 9 into the pan 5 for removal by the customer. As before, the denomination-mix involved may be selected—by manipulation of the keyboard 13 in this case—or failing such selection, is determined by the programming of the unit 10. The dispensing of banknotes to the customer is preferably preceded by release of the customer's card from the card reader 14 and removal of this by the customer.

The card reader 14 may also be utilized when the equipment is operating in the first, manned mode, in the event that the dispensing of cash to a customer is to be secured against the customer's credit- or bank-card. To this end, the unit 10 may respond to entry by the teller of an appropriate code via the keyboard 12 to energize the card reader 14. The customer is then requested to insert his card in the reader 14 to enable the appropriate information to be read out into the unit 10 for checking. As an alternative, as illustrated, the unit 11 may be provided with a wipe-through card reader 24 for use by the teller to read out into the unit 10 information encoded on the customer's card presented in these circumstances via the pan 5. However where the transaction is to be further checked by entry of the customer's secret number for comparison with the account number read from the card, the customer is invited to make such entry using the keyboard 13; the teller first enters an appropriate code via the keyboard 12 to bring about energization of the keyboard 13 for this purpose.

A cheque-endorsing printer may be incorporated into the unit 11 so that as the teller enters information through the keyboard 12 in relation to a cheque-based transaction, that information is at the same time printed out onto the cheque so as to assist clearance of the cheque subsequently. Furthermore, the dispenser 8 (which may be constructed as described in U.S. Pat. No. 4,066,253 issued to Lunblad et al. on Jan. 3, 1978) may include a facility for dispensing coin into the pan 5 as well as banknotes.

I claim:

1. A teller machine for use at a transaction location for delivery of items in accordance with a customer-requested transaction at that location, comprising transaction-counter means having a counter-surface for separating the customer from a human teller at the transaction location and across which counter-surface face to face personal service to the customer can be provided by the human teller, means including a first keyboard for defining a teller's station located to one side of the counter means, means including a second keyboard for defining a customer's station separated from the teller's station across the counter-surface, item-receptacle means located intermediate the customer's and teller's stations across the counter-surface, said receptacle means having a top opening within reach of the customer and the human teller when occupying their respective stations for access to the contents of said receptacle means, dispenser means operable to dispense items through an opening in a wall of said receptacle means different from said top opening for subsequent delivery via said top opening from the receptacle means to said customer, control means for controlling operation of said dispenser means, said control means being switchable selectively to a first mode in which it is responsive to operation of said first keyboard to operate said dispenser means under manual control from said first keyboard, or to a second mode in which the control means operates said dispenser means under machine control in dependence upon data entered via said second keyboard, and means operable from said teller's station to obstruct or enable, selectively, access from said customer's station via said top opening to the contents of said receptacle-means.

2. A teller machine according to claim 1 wherein said last-named means comprises a slideable lid overlying the top of said receptacle means.

* * * * *